US008907877B2

(12) United States Patent
Chung et al.

(10) Patent No.: US 8,907,877 B2
(45) Date of Patent: Dec. 9, 2014

(54) APPARATUS AND METHOD FOR DRIVING LIQUID CRYSTAL DISPLAY DEVICE

(75) Inventors: Dong Il Chung, Gyeongsangbuk-do (KR); Kyoung Hun Lee, Gyeongsangbuk-do (KR)

(73) Assignee: LG Display Co., Ltd., Seoul (KR)

( * ) Notice: Subject to any disclaimer, the term of this patent is extended or adjusted under 35 U.S.C. 154(b) by 1256 days.

(21) Appl. No.: 11/640,334

(22) Filed: Dec. 18, 2006

(65) Prior Publication Data

US 2008/0001903 A1 Jan. 3, 2008

(30) Foreign Application Priority Data

Jun. 29, 2006 (KR) ..... 10-2006-0059339

(51) Int. Cl.
*G09G 3/36* (2006.01)

(52) U.S. Cl.
CPC ..... *G09G 3/3655* (2013.01); *G09G 3/3688* (2013.01); *G09G 2310/027* (2013.01); *G09G 2320/0204* (2013.01); *G09G 2320/0247* (2013.01); *G09G 2360/16* (2013.01)
USPC ..... 345/87

(58) Field of Classification Search
CPC ..... G09G 3/3655; G09G 3/3688; G09G 2310/027; G09G 2320/0204; G09G 2320/0247
USPC ..... 345/87
See application file for complete search history.

(56) References Cited

U.S. PATENT DOCUMENTS

| | | | | |
|---|---|---|---|---|
| 5,926,162 | A * | 7/1999 | Wood et al. | 345/101 |
| 7,495,648 | B2 * | 2/2009 | Kang et al. | 345/100 |
| 2004/0169627 | A1 * | 9/2004 | Hong | 345/89 |
| 2006/0146128 | A1 * | 7/2006 | Ma et al. | 348/89 |
| 2006/0158412 | A1 * | 7/2006 | Morita | 345/94 |

FOREIGN PATENT DOCUMENTS

KR 1020070120671 A 12/2007

OTHER PUBLICATIONS

Machine Translation of KR10-2006-0055227.*
Korean Office Action dated Sep. 10, 2012.

* cited by examiner

*Primary Examiner* — Stephen Sherman
*Assistant Examiner* — Randal Willis
(74) *Attorney, Agent, or Firm* — Morgan, Lewis & Bockius LLP

(57) ABSTRACT

An apparatus for driving a liquid crystal display device includes a liquid crystal display panel; a plurality of data ICs supplying data voltages to the liquid crystal display panel; a plurality of gate ICs supplying a gate signal to the liquid crystal display panel; and a common voltage generating unit that generates a common voltage to drive the liquid crystal display panel with a difference between the common voltage and the at least one of the data voltages, the common voltage depending on at least one of the data voltages.

15 Claims, 6 Drawing Sheets

APPARATUS AND METHOD FOR DRIVING LIQUID CRYSTAL DISPLAY DEVICE

This application claims the benefit of Korean Patent Application No. 10-2006-0059339, filed on Jun. 29, 2006 which is hereby incorporated by reference in its entirety.

BACKGROUND OF THE INVENTION

1. Field of the Invention

Embodiments of the present invention relates to a liquid crystal display (LCD) device, and more particularly to an apparatus and method for driving an LCD device. Embodiments of the invention are suitable for a wide scope of applications. In particular, embodiments of the invention are suitable for improving the picture quality of an LCD device in accordance with the driving thereof.

2. Discussion of the Related Art

Liquid crystal display (LCD) devices have been developed as alternatives to cathode ray tube (CRT) devices because they are thinner and lighter than their CRT counterparts. An LCD device includes two substrates, and a layer of a liquid crystal material between the two substrates. The liquid crystal material has anisotropic dielectric properties. Accordingly, the LCD device can display a desired image by controlling a light transmittance of the liquid crystal material in accordance with the level of an electric field applied to the liquid crystal material.

The LCD device further includes a plurality of gate lines in one direction on a substrate, and a plurality of data lines insulated from and crossing the gate lines. Crossings of the gate and data lines define pixel regions. Switching devices, such as thin film transistors (TFT), are formed adjacent to the crossings of the gate and data lines.

FIG. 1 shows a circuit diagram of a pixel region of an LCD device according to the related art. Referring to FIG. 1, a switching part, such as a thin-film transistor (TFT), is connected with the n-th gate line (GLn) and the m-th data line (DLm) in the corresponding pixel region and a pixel electrode (P) is connected with the TFT. For example, a gate electrode (g) of the TFT is connected with the n-th gate line (GLn), a source electrode (s) thereof is connected with the m-th data line (DLm), and a drain electrode (d) thereof is connected with the pixel electrode.

The pixel electrode (P) faces a common electrode (C). A liquid crystal material between the pixel electrode (P) and the common electrode (C) forms an equivalent liquid crystal capacitor (Clc) between the pixel electrode P and the common electrode C. Also, a storage capacitor (Cst) is formed in an overlapped portion between the pixel electrode and the (n−1)-th gate line (GLn-1). Also, a parasitic capacitance (Cgd) is formed between the gate electrode (g) and the drain electrode (D) due to misalignment. A common voltage Vcom is applied to the common electrode (C).

The operation of the LCD device including the pixel region will be explained as follows. First, the TFT is turned-on by applying a gate pulse to the gate electrode connected with the corresponding gate line (GLn). Then, a data voltage is applied to the source electrode (s) and is applied to the drain electrode (d). The data voltage is applied to the liquid crystal capacitor (Clc) and the storage capacitor (Cst) through the pixel electrode (P). Accordingly, an electric field is formed by a difference of electric potential between the pixel electrode (P) and the common electrode (C).

If an electric field of the same direction is continuously applied to the liquid crystal material, the liquid crystal material may deteriorate. To prevent the deterioration of the liquid crystal material, the polarity of data voltage is inverted with respect to the common voltage (Vcom).

FIG. 2 shows a circuit diagram of an apparatus for generating a common voltage according to the related art. Referring to FIG. 2, the related art apparatus for generating a common voltage includes a first resistor (R1), a variable resistor (VR), and a second resistor (R2) connected in series between a power voltage terminal (VDD) and ground (VSS). In addition, an output terminal (No) is provided between the variable resistor (VR) and the second resistor (R2).

The first and second resistors (R1, R2) have fixed resistance values, and the variable resistor (VR) has a variable resistance value adjustable by a user. The voltage divided by the resistors (R1, VR, R2) is outputted at the output terminal (No) as a common voltage (Vcom) having a DC level. The common voltage (Vcom) is controlled in accordance with the resistance value of the variable resistor (VR).

The related art apparatus for generating a common voltage may cause a flicker phenomenon in an LCD device. The displayed image on the LCD device flickers whenever a variation in the common voltage (Vcom) causes the data voltage to change state. To decrease the flicker phenomenon, the user has to manually adjust the resistance value of the variable resistor (VR) to achieve an optimum value for the common voltage (Vcom) to be transmitted to the LCD panel. However, manual adjustment is not reliable for providing the optimal common voltage (Vcom) to the LCD panel.

If the common voltage (Vcom) changes, the common voltage (Vcom) is no longer the central value of the data voltage. Thus, the voltage value charged in the pixel electrode changes frame by frame, thereby causing the flicker phenomenon. The flicker phenomenon becomes more and more serious as the LCD panel increases in size.

SUMMARY OF THE INVENTION

Accordingly, embodiments of the present invention are directed to an apparatus and method for driving an LCD device that substantially obviate one or more problems due to limitations and disadvantages of the related art.

An object of the present invention is to provide an apparatus and method for driving an LCD device having an improved picture quality.

Another object of the present invention is to provide an apparatus and method for driving an LCD device that prevents a flicker phenomenon.

Additional features and advantages of the invention will be set forth in the description of exemplary embodiments which follows, and in part will be apparent from the description of the exemplary embodiments, or may be learned by practice of the exemplary embodiments of the invention. These and other advantages of the invention will be realized and attained by the structure particularly pointed out in the written description of the exemplary embodiments and claims hereof as well as the appended drawings.

To achieve these objects and other advantages and in accordance with the purpose of the invention, as embodied and broadly described herein, an apparatus for driving an LCD device includes an LCD panel; a plurality of data ICs supplying data voltages to the LCD panel; a plurality of gate ICs supplying a gate signal to the LCD panel; and a common voltage generating unit that generates a common voltage to drive the LCD panel with a difference between the common voltage and the at least one of the data voltages, the common voltage depending on at least one of the data voltages.

In another aspect, an apparatus for driving an LCD device includes an LCD panel; a plurality of data ICs, each of which outputting a plurality of data voltages and an average of the data voltages for driving the LCD panel; a plurality of gate ICs supplying a gate signal to the LCD panel; and a common voltage generating unit that generates a common voltage to drive the LCD panel with a difference between the common voltage and at least one of plurality of data voltages, the common voltage depending on the average of the data voltages from each of the plurality of data ICs.

In another aspect, a method is provided for driving an LCD device including an LCD panel, a plurality of data ICs and a plurality of gate ICs; the method includes supplying data voltages from the plurality of data ICs to the LCD panel; supplying a gate signal from the plurality of gate ICs to the LCD panel; and generating a common voltage depending on at least one of the data voltages; and driving the LCD panel with a difference between the common voltage and the at least one of the data voltages.

In another aspect, a method is provided for driving an LCD device including an LCD panel, a plurality of data ICs and a plurality of gate ICs; the method includes outputting a plurality of data voltages and an average of the data voltages through each of a plurality of data ICs; supplying a gate signal from the plurality of gate ICs to the LCD panel; and generating a common voltage to drive the LCD panel with a difference between the common voltage and at least one of plurality of data voltages, the common voltage depending on the average of the data voltages from each of the plurality of data ICs.

In another aspect, an apparatus for driving an LCD device includes an LCD panel; a plurality of data ICs, each of which outputting a plurality of data voltages for driving the LCD panel and including a data-voltage averaging unit to generate an average of the data voltages; a plurality of gate ICs supplying a gate signal to the LCD panel; and a common voltage generating unit that generates a common voltage to drive the LCD panel in accordance with a difference between the common voltage and at least one of plurality of data voltages, the common voltage depending on the average of the data voltages from the data-voltage averaging unit in each of the plurality of data ICs.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF EXEMPLARY EMBODIMENTS

Reference will now be made in detail to exemplary embodiments of the present invention, which are illustrated in the accompanying drawings. Wherever possible, the same reference numbers will be used throughout the drawings to refer to the same or like parts.

Figure 1:
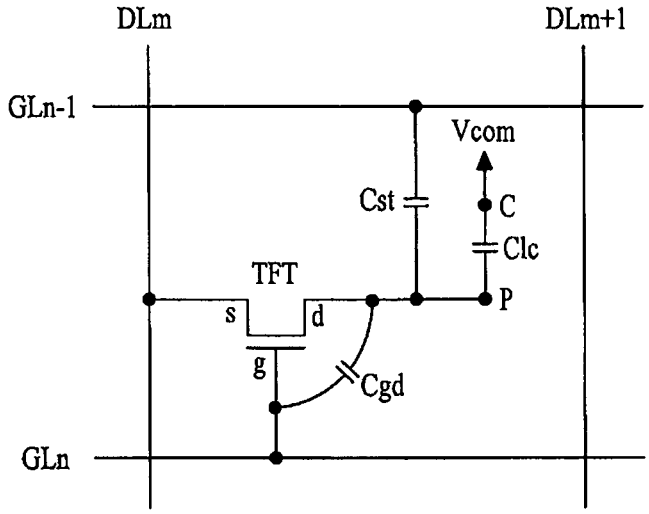
FIG. 1 Related Art
FIG. 1 shows a circuit diagram of a pixel region of an LCD device according to the related art.
Figure 2:
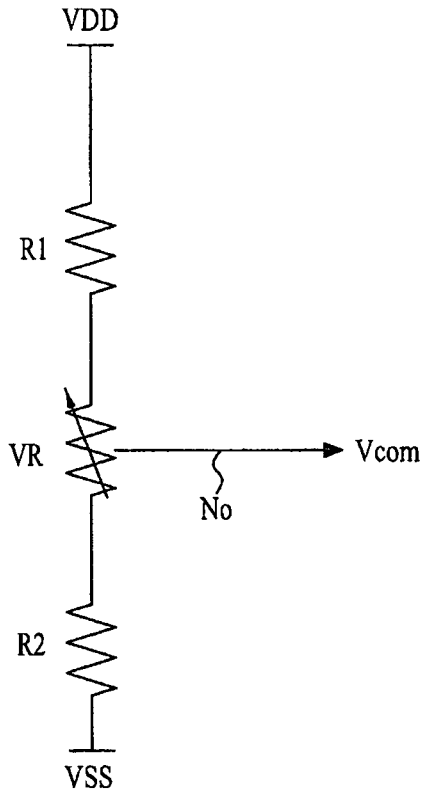
FIG. 2 Related Art
FIG. 2 shows a circuit diagram of an apparatus for generating a common voltage according to the related art.
Figure 3:
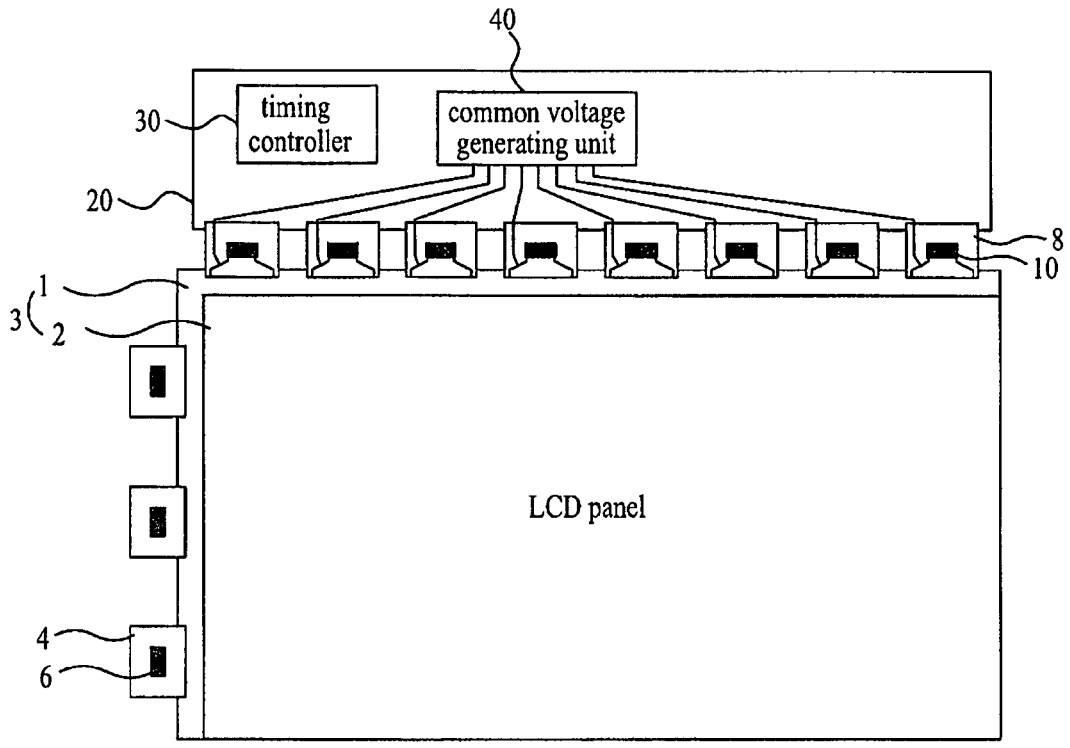
FIG. 3 shows a schematic view of a first exemplary driving apparatus for an LCD panel according to an embodiment of the present invention.

FIG. 3 shows a schematic view of an exemplary driving apparatus for an LCD panel according to an embodiment of the present invention. Referring to FIG. 3, the driving apparatus for the LCD device includes an LCD panel 3. The LCD panel 3 includes a first substrate 1 and a second substrate 2. A liquid crystal material is provided between the first and second substrates 1 and 2 of the LCD panel 3. In addition, spacers may be provided to maintain a fixed interval between the first and second substrates 1 and 2.

The first substrate 1 includes a plurality of gate and data lines crossing each other to form pixel regions. The second substrate 2 may include a color filter (not shown), a common electrode (not shown), and a black matrix (not shown). A common electrode may be formed on one of the first substrate 1 or the second substrate 2, depending on a mode of the liquid crystal material.

Gate ICs 6 are provided to supply gate pulses to the LCD panel 3. Data ICs 10 are also provided to supply data voltages to the LCD panel 3. A PCB 20 is connected with the respective data ICs 10 and the LCD panel 3. A timing controller 30 is mounted on the PCB 20 and controls the gate and data ICs 6 and 10. A common voltage generating unit 40 is mounted on the PCB 20 and generates a common voltage that depends on at least one of the data voltages outputted from the plurality of data ICs 10. Data and gate pad regions respectively connected with the data and gate lines, respectively, at one side of the first substrate 1. The PCB 20 is connected with the plurality of data ICs 10. The LCD panel 3 displays images by varying the light transmittance of the liquid crystal material in accordance with a difference of electric potential between the data voltage and the common voltage.

A plurality of TFTs and pixel electrodes are formed adjacent to respective crossings of the gate and data lines. Each the TFT supplies a data voltage from the corresponding data line to the pixel electrode in response to the gate pulse supplied from the gate line.

The timing controller 30 arranges digital data inputted from the external to be appropriate for driving of the LCD panel 3, and supplies the arranged digital data to the plurality of data ICs 10. The timing controller 30 also generates a gate control signal to control the gate ICs 6, and a data control signal to control the data ICs 10, by using a dot clock (Dclk), a horizontally synchronized signal (Hsync), a vertically synchronized signal (Vsync), and a data enable (DE), which may be externally provided.

Each of the plurality of gate ICs 6 is mounted on a gate tape carrier package 4. Each gate tape carrier package 4 is attached to the gate pad region of the first substrate 1. The plurality of gate ICs 6 sequentially generate the gate pulse in accordance with the gate control signal supplied from the timing controller 30, and sequentially supply the generated gate pulse to the gate lines.

Each of the plurality of data ICs 10 is mounted on a data tape carrier package 8. Each data tape carrier package 8 is attached to the PCB 20 and the data pad region of the first substrate 1. The plurality of data ICs 10 convert the digital data supplied from the timing controller 30 into an analog data voltage in accordance with the data control signal supplied from the timing controller 30, and supply the analog data voltage to each data line.

At least one output channel of each data IC 10 is connected to the common voltage generating unit 40 by the data tape carrier package 8. Accordingly, some of the output channels of the data ICs 10 supply the data voltage to the data line and the common voltage generating unit 40, simultaneously. The data voltage supplied to the common voltage generating unit 40 from the data ICs 10 is defined as a feedback voltage.

Figure 4:
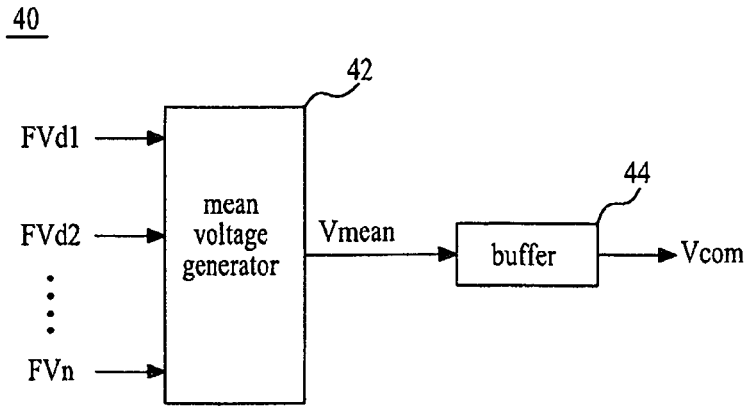
FIG. 4 shows a schematic view of an exemplary common voltage generating unit in the driving apparatus of FIG. 3.
Figure 5:
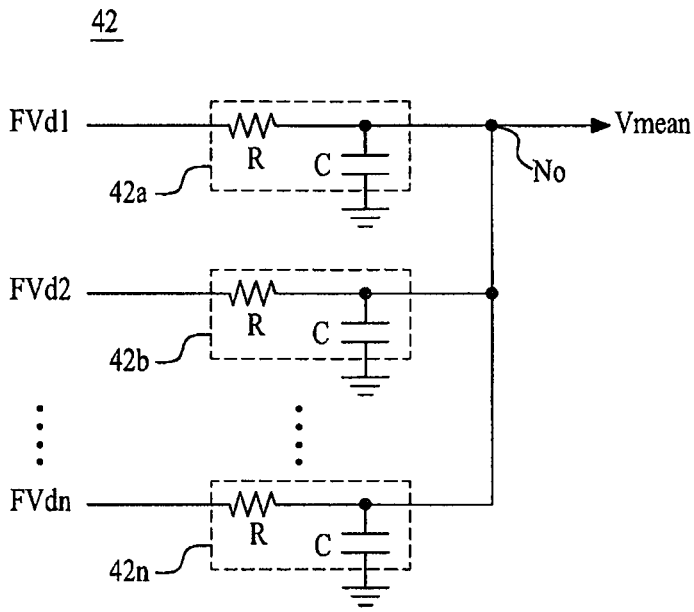
FIG. 5 shows a schematic view of a first exemplary mean voltage generating unit in the common voltage generating unit of FIG. 4.

FIG. 4 shows a schematic view of an exemplary common voltage generating unit in the driving apparatus of FIG. 3. FIG. 5 shows a schematic view of a first exemplary mean voltage generating unit in the common voltage generating unit of FIG. 4. Referring to FIG. 4, the common voltage generating unit 40 includes a mean voltage generator 42 and a buffer 44. As shown in FIG. 5, the mean voltage generator 42 includes a plurality of smoothing circuits 42*a* to 42*n* for smoothing the feedback voltages FVd1 to FVdn supplied from at least one output channel of the respective data ICs 10.

Each of the plurality of smoothing circuits 42*a* to 42*n* includes a RC filter (RC) that smoothes the corresponding one of the feedback voltages FVd1 to FVdn and output the corresponding one of the smoothed feedback voltage FVd1 to FVdn to the output terminal No. The mean voltage Vmean is determined at the output terminal No based on the level of the smoothed feedback voltages FVd1 to FVdn.

Figure 6:
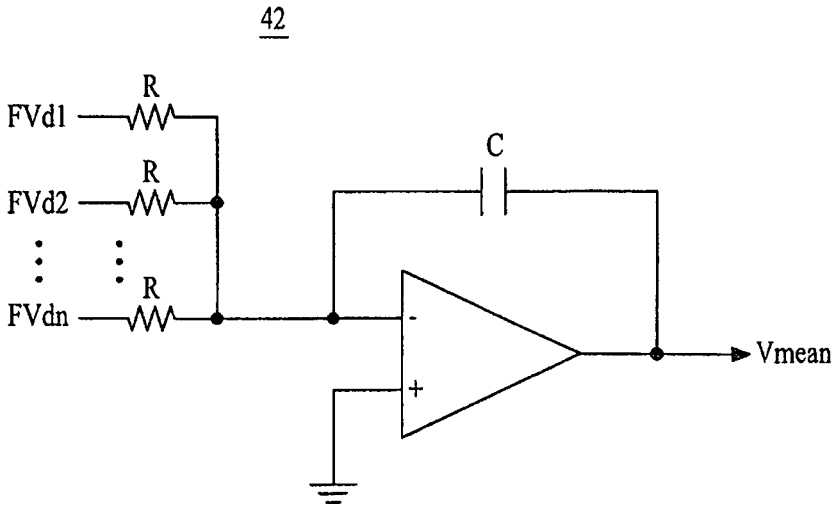
FIG. 6 shows a schematic view of a second exemplary mean voltage generating unit in the common voltage generating unit of FIG. 4.

FIG. 6 shows a schematic view of a second exemplary mean voltage generating unit in the common voltage generating unit of FIG. 4. Referring to FIG. 6, the mean voltage generator 42 may include an integral circuit which generates the mean voltage Vmean by integrating the feedback voltages FVd1 to FVdn from at least one output channel of the respective data ICs 10.

The buffer 44 generates the common voltage Vcom by amplifying the mean voltage Vmean from the mean voltage generator 42 in accordance with the load of the common electrode, and supplies the generated common voltage (Vcom) to the common electrode of the LCD panel 3.

In accordance with an embodiment of the invention, the common voltage generating unit 40 generates the common voltage Vcom by averaging the feedback voltages FVd1 to FVdn from at least one output channel of the respective data ICs 10. Accordingly, the generated common voltage Vcom is optimal for each data pattern to be displayed on the LCD panel 3.

In accordance with an embodiment of the invention, the driving apparatus of the LCD device generates the common voltage Vcom by using the data voltages outputted from the plurality of data ICs 10. Thus, the picture quality of images displayed on the LCD panel 3 can be improved without the need for manual operation by the user.

Figure 7:
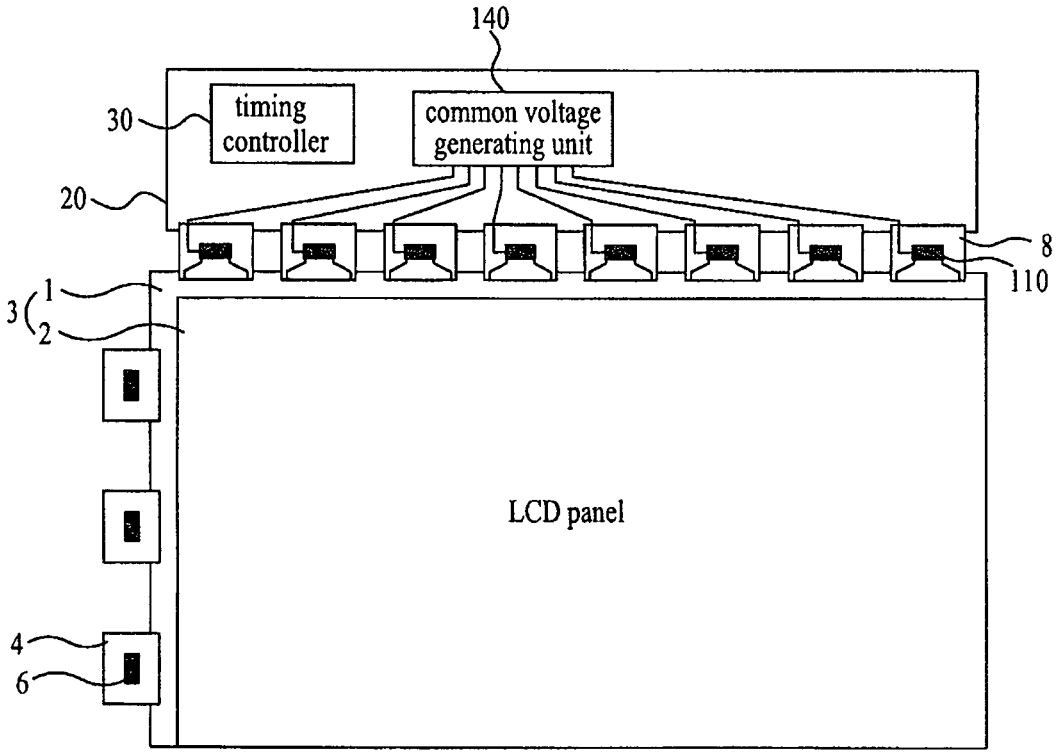
FIG. 7 shows a schematic view of a second exemplary driving apparatus for an LCD panel according to another embodiment of the present invention.

FIG. 7 shows a schematic view of a second exemplary driving apparatus for an LCD panel according to another embodiment of the present invention. Referring to FIG. 7, the driving apparatus of the LCD device includes an LCD panel 3 which drives liquid crystal in accordance with a difference of electric potential between one of a plurality of data voltages and a common voltage, and displays images based on a light transmittance of liquid crystal; a plurality of gate ICs 6 supplying a gate pulse to the LCD panel 3; a plurality of data ICs 110 supplying the data voltages to the LCD panel 3 and output an average voltage of the supplied data voltages; a PCB 20 connected to the respective data ICs 110 and the LCD panel 3; a timing controller 30 mounted on the PCB 20 to control the gate and data ICs 6 and 110; and a common voltage generating unit 140 mounted on the PCB 20 to generate the common voltage by using the average voltage from the plurality of data ICs 110.

The LCD panel 3, the plurality of gate ICs 6, the PCB 20, and the timing controller 30 in FIG. 7 are substantially similar to those of FIG. 3. Accordingly, further description of these parts will be omitted.

Figure 8:
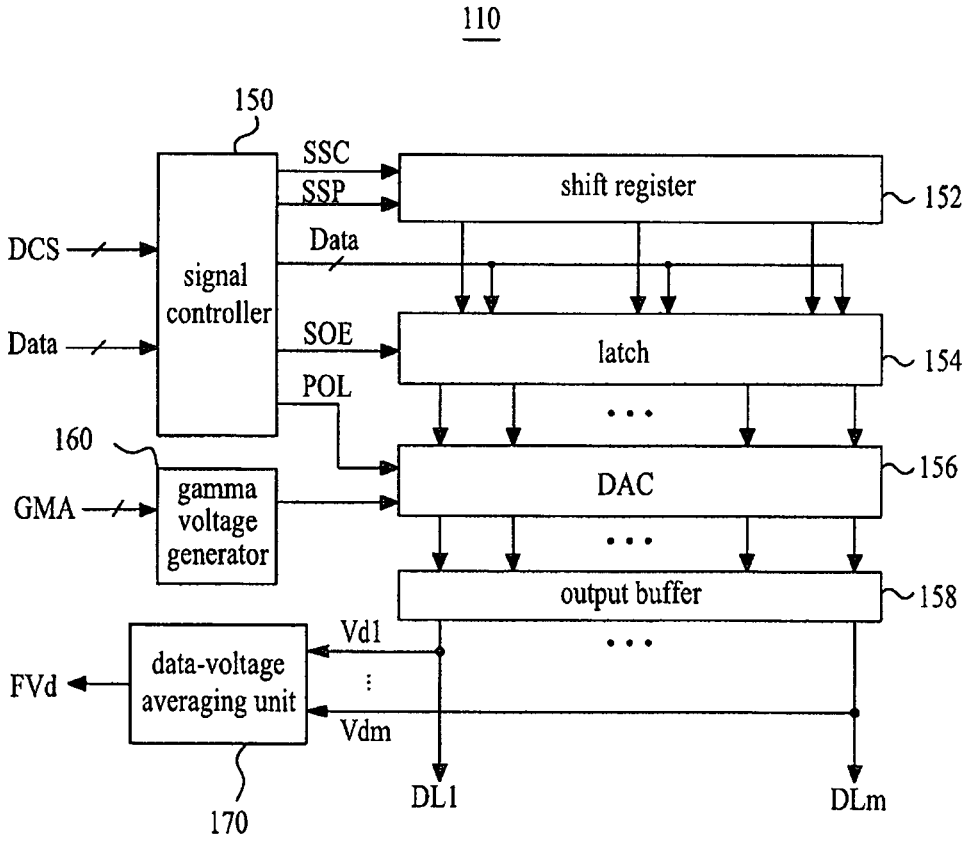
FIG. 8 shows a schematic view of an exemplary data IC in the driving apparatus of FIG. 7.

FIG. 8 shows a schematic view of an exemplary data IC in the driving apparatus of FIG. 7. Referring to FIG. 8, each of the plurality of data ICs 110 includes a signal controller 150 relaying digital data Data and the data control signal (DCS) from the timing controller 30; a gamma voltage generator 160 which generates a plurality of gamma voltages by subdividing a plurality of reference gamma voltages GMA; a shift register 152 which supplies a sampling signal sequentially; a latch 154 which sequentially latches the digital data Data supplied from the signal controller 150 in response to the sampling signal; a digital-analog converter (DAC) 156 which converts the digital data Data latched by the latch 154 into the analog data voltage; an output buffer 158 which buffers the data voltage supplied from the DAC 156, and outputs the buffered data voltage; and a data-voltage averaging unit 170 which generates an average voltage FVd of data voltages Vd1 to Vdm from the output buffer 158, and outputs the generated average voltage FVd to the common voltage generating unit 140. The data ICs 110 supplies the data voltage to the data lines corresponding to the number of output channels in the output buffer 158.

The signal controller 150 relays the digital data Data and various control signals SSP, SSC, SOE, POL from the timing controller 30 to the corresponding components. The gamma voltage generator 160 subdivides the plurality of reference gamma voltages GMA from a reference gamma voltage generator mounted on a PCB 20 (not shown), into the plurality of gamma voltages corresponding to the number of gray scales of the digital data Data and supplies the plurality of gamma voltages to the DAC 156.

The shift register 152 sequentially shifts the source start pulse (SSP) from the signal controller 150 in accordance with the source sampling clock (SSC), and outputs the shifted SSP as the sampling signal. Simultaneously, the shift register 152 generates a carry signal, and supplies the generated carry signal to the shift register 152 of the next data IC 110.

The latch 154 sequentially samples the digital data Data supplied from the signal controller 150 in accordance with the sampling signal of the shift register 152. Then, the latch 154 latches the sampled digital data Data for one horizontal line and outputs the digital data Data for one horizontal line to the DAC 156.

The DAC 156 converts the digital data Data latched by the latch 154 into the data voltage, and outputs the data voltage to the output buffer 158. Then, the DAC 156 converts the digital data Data into a positive or negative data voltage in accordance with the polarity control signal POL from the signal controller 150.

The output buffer 158 buffers the data voltages Vd1 to Vdm from the DAC 156. The output buffer 158 supplies the buffered data voltages to the data lines DL1 to DLm and the data-voltage averaging unit 170.

The data-voltage averaging unit 170 averages the data voltages Vd1 to Vdm from the respective output channels of the output buffer 158 to generate an average voltage FVd of the data voltages Vd1 to Vdm. The data-voltage averaging unit 170 supplies the generated average voltage FVd to the common voltage generating unit 140.

The common voltage generating unit 140 generates a mean voltage Vmean (shown in FIGS. 5 and 6) by averaging the average voltages FVd from the data-voltage averaging unit 170 of the respective data IC's 110. The common voltage generating unit 140 amplifies the mean voltage Vmean to generate the common voltage Vcom. Accordingly, the common voltage generating unit 140 may include smoothing circuits as shown in FIG. 5, or integral circuits as shown in FIG. 6.

According to an embodiment of the invention, the common voltage Vcom is generated in the driving apparatus of the LCD device by averaging the data voltages outputted from the data ICs 110. Accordingly, the generated common voltage Vcom is optimal for each data pattern to be displayed on the LCD panel 3. Thus, the picture quality of images displayed on the LCD panel 3 can be improved without the need for manual operation by the user.

According to an embodiment of the invention, the common voltage is generated using the data voltage applied to the LCD panel to prevent a deterioration of the picture quality by the common voltage. The generated common voltage Vcom is optimal for each data pattern to be displayed on the LCD panel 3. Accordingly, the picture quality of displayed images is improved. whereby there is no requirement for controlling the common voltage by the hand operation.

It will be apparent to those skilled in the art that various modifications and variations can be made in the exemplary embodiments of the present invention. Thus, it is intended that embodiments of the invention cover the modifications and variations of the embodiments described herein provided they come within the scope of the appended claims and their equivalents.

What is claimed is:

1. An apparatus for driving a liquid crystal display device, comprising:
- a liquid crystal display panel;
- a plurality of data ICs supplying data voltages to data lines of the liquid crystal display panel;
- a plurality of gate ICs supplying a gate signal to the liquid crystal display panel; and
- a common voltage generating unit, comprising:
  - a plurality of smoothing circuits, each configured to:
    - receive an average of the data voltages from a respective one of the plurality of data ICs; and
    - output a smoothed average data voltage for the respective one of the plurality of data ICs,
  - wherein the common voltage generating unit is configured to:
    - generate a common voltage to drive the liquid crystal display panel with a difference between the common voltage and the at least one of the data voltages from each of the plurality of data ICs, the common voltage depending on an average of all of the smoothed averages from all of the plurality of smoothing circuits.

2. The apparatus of claim 1, wherein the common voltage generating unit includes a mean voltage generator for generating a mean voltage of the data voltages from the data ICs.

3. The apparatus of claim 2, wherein the common voltage generating unit includes a buffer for amplifying the mean voltage.

4. An apparatus for driving a liquid crystal display device, comprising:
- a liquid crystal display panel;
- a plurality of data ICs, each of which outputting a plurality of data voltages to data lines of the liquid crystal display panel and an average of the data voltages of the data lines for driving the liquid crystal display panel;
- a plurality of gate ICs supplying a gate signal to the liquid crystal display panel; and
- a common voltage generating unit, comprising:
  - a plurality of smoothing circuits, each configured to:
    - receive the average of the data voltages from a respective one of the plurality of data ICs; and
    - output a smoothed average data voltage for the respective one of the plurality of data ICs,
  - wherein the common voltage generating unit is configured to:
    - generate a common voltage to drive the liquid crystal display panel with a difference between the common voltage and at least one of plurality of data voltages, the common voltage depending on an average of all of the smoothed averages from all of the plurality of smoothing circuits.

5. The apparatus of claim 4, wherein each of the plurality of data ICs includes:
- a shift register which sequentially generates a sampling signal;
- a latch which latches digital data in accordance with the sampling signal;
- a digital-analog converter which converts the latched digital data into the data voltage;
- an output buffer which outputs the data voltage to the data lines of the liquid crystal display panel; and
- a data-voltage averaging unit which generates the average of the data voltages.

6. The apparatus of claim 4, wherein the common voltage generating unit includes a mean voltage generator for generating a mean of the average of the data voltages from each of the plurality of data ICs.

7. The apparatus of claim 6, wherein the common voltage generating unit includes a buffer for amplifying the mean of the average of the data voltages from each of the plurality of data ICs to generate to common voltage.

8. A method for driving a liquid crystal display device including a liquid crystal display panel, a plurality of data ICs and a plurality of gate ICs, the method comprising:
- supplying data voltages from the plurality of data ICs to data lines of the liquid crystal display panel;
- supplying a gate signal from the plurality of gate ICs to the liquid crystal display panel; and
- respectively receiving, at a plurality of smoothing circuits, an average of the data voltages from a respective one of the plurality of data ICs;
- respectively outputting, by the plurality of smoothing circuits, a smoothed average data voltage for the respective one of the plurality of data ICs; and
- generating a common voltage depending on an average of all of the smoothed averages from all of the plurality of smoothing circuits; and
- driving the liquid crystal display panel with a difference between the common voltage and the at least one of the data voltages.

9. The method of claim 8, further comprising generating a mean voltage of the data voltages from each of the data ICs.

10. The method of claim 9, further comprising amplifying the mean voltage.

11. A method for driving a liquid crystal display device including a liquid crystal display panel, a plurality of data ICs and a plurality of gate ICs, the method comprising:

outputting a plurality of data voltages to data lines of the liquid crystal display panel and supplying an average of the data voltages of data lines to a common voltage generation unit through each of a plurality of data ICs;

supplying a gate signal from the plurality of gate ICs to the liquid crystal display panel; and respectively receiving, at a plurality of smoothing circuits, the average of the data voltages from a respective one of the plurality of data ICs;

respectively outputting, by the plurality of smoothing circuits, a smoothed average data voltage for the respective one of the plurality of data ICs; and generating a common voltage to drive the liquid crystal display panel with a difference between the common voltage and at least one of plurality of data voltages, the common voltage depending on an average of all of the smoothed averages from all of the plurality of smoothing circuits.

12. The method of claim 11, wherein the generating a common voltage includes generating a mean of the average of the data voltages from each of the plurality of data ICs.

13. The method of claim 11, further comprising amplifying the mean of the average of the data voltages from each of the plurality of data ICs.

14. An apparatus for driving a liquid crystal display device, comprising:

a liquid crystal display panel;

a plurality of data ICs, each of which outputting a plurality of data voltages to data lines of the liquid crystal display panel and including a data-voltage averaging unit to generate an average of the data voltages from each of the plurality of data ICs;

a plurality of gate ICs supplying a gate signal to the liquid crystal display panel; and a common voltage generating unit, comprising:

a plurality of smoothing circuits, each configured to:

receive the average of the data voltages from a respective one of the plurality of data ICs; and output a smoothed average data voltage for the respective one of the plurality of data ICs, wherein the common voltage generating unit is configured to:

generate a common voltage to drive the liquid crystal display panel with a difference between the common voltage and at least one of plurality of data voltages, the common voltage depending on an average of all of the smoothed averages from all of the plurality of smoothing circuits.

15. The apparatus of claim 14, wherein the common voltage generating unit includes a mean voltage generator for generating a mean of the average of the data voltages from each of the plurality of data ICs.

* * * * *